US009560465B2

(12) United States Patent
Stein et al.

(10) Patent No.: US 9,560,465 B2
(45) Date of Patent: Jan. 31, 2017

(54) DIGITAL AUDIO FILTERS FOR VARIABLE SAMPLE RATES

(71) Applicant: DTS, Inc., Calabasas, CA (US)

(72) Inventors: Edward Stein, Capitola, CA (US); Martin Walsh, Scotts Valley, CA (US); Michael Kelly, London (GB)

(73) Assignee: DTS, Inc., Calabasas, CA (US)

( * ) Notice: Subject to any disclaimer, the term of this patent is extended or adjusted under 35 U.S.C. 154(b) by 63 days.

(21) Appl. No.: 14/506,187

(22) Filed: Oct. 3, 2014

(65) Prior Publication Data

US 2016/0100268 A1 Apr. 7, 2016

(51) Int. Cl.
*H04R 5/00* (2006.01)
*H04S 5/00* (2006.01)
*H04S 7/00* (2006.01)

(52) U.S. Cl.
CPC . *H04S 5/00* (2013.01); *H04R 5/00* (2013.01); *H04S 7/301* (2013.01); *H04S 2420/01* (2013.01)

(58) Field of Classification Search
None
See application file for complete search history.

(56) References Cited

U.S. PATENT DOCUMENTS 6,427,157 B1 7/2002 Webb
7,653,447 B2 * 1/2010 Chung ..... H04L 12/2803 348/515
2005/0248476 A1 11/2005 Wiser et al.
2006/0045294 A1 3/2006 Smyth
2006/0212503 A1 9/2006 Beckmann et al.
2012/0214416 A1 * 8/2012 Kent ..... H04L 63/18 455/41.2
2015/0320344 A9 * 11/2015 Van Hasselt ..... H04R 25/00 600/559

FOREIGN PATENT DOCUMENTS

WO 2013/0491253 4/2013
WO WO2013098342 A2 7/2013

OTHER PUBLICATIONS

Julius O. Smith, III, "The Digital Audio Resampling Home Page", url: https://ccrma.standord.edu/~jos/resample/, Copyright Feb. 23, 2015, Center for Computer Research in Music and Acoustics, Standford University, US.

(Continued)

*Primary Examiner* — Muhammad N Edun
(74) *Attorney, Agent, or Firm* — William Johnson; Craig Fischer; Jianning Mai

(57) ABSTRACT

Various exemplary embodiments relate to a method and apparatus for processing audio signals to influence the reproduction of the audio signals. The apparatus may include a speaker, a headphone (over-the-ear, on-ear, or in-ear), a microphone, a computer, a mobile device, a home theater receiver, a television, a Blu-ray (BD) player, a compact disc (CD) player, a digital media player, or the like. The apparatus may be configured to receive a virtualization profile including a digital audio filter with a design sample rate, resample the virtualization profile to a different sample rate, filter the audio signal with the resampled virtualization profile, and reproduce the filtered audio signal as sound.

17 Claims, 7 Drawing Sheets

(56) References Cited

OTHER PUBLICATIONS

James Kaiser, Kaiser Window from Wikipedia, "Parametric family of Kaiser windows", url: http://en.wikipedia.org/wiki/Kaiser_window, Nov. 27, 2013, Bell Laboratories, Madison, WI, US.
International Search Report and Written Opinion of the International from the International Searching Authority, in related PCT Application No. PCT/US2015/38635, 17 pages.

* cited by examiner

DIGITAL AUDIO FILTERS FOR VARIABLE SAMPLE RATES

BACKGROUND

In traditional audio reproduction, digital audio filters are designed for particular sample rates. If audio is reproduced at a different sample rate than the designed sample rate, digital audio filters must be redesigned or the applied filter effects need to be scaled in frequency. It would therefore be desirable to have a method and apparatus to deliver a flexible filter design that adapts to variable sample rates.

SUMMARY

A brief summary of various exemplary embodiments is presented. Some simplifications and omissions may be made in the following summary, which is intended to highlight and introduce some aspects of the various exemplary embodiments, but not to limit the scope of the invention. Detailed descriptions of a preferred exemplary embodiment adequate to allow those of ordinary skill in the art to make and use the inventive concepts will follow in later sections.

Various exemplary embodiments relate to a method and apparatus for processing audio signals to influence the reproduction of the audio signals. The apparatus may include a speaker, a headphone (over-the-ear, on-ear, or in-ear), a microphone, a computer, a mobile device, a home theater receiver, a television, a Blu-ray (BD) player, a compact disc (CD) player, a digital media player, or the like. The apparatus may be configured to receive a virtualization profile including a digital audio filter with a design sample rate, resample the virtualization profile to a different sample rate, filter the audio signal with the resampled virtualization profile, and reproduce the filtered audio signal as sound.

Various exemplary embodiments further relate to a method for processing an audio signal to influence the reproduction of the audio signal, the method comprising: sending a request to a server computer for a virtualization profile, wherein the request specifies a requested sample rate for the virtualization profile, and wherein the virtualization profile defines a digital audio filter; receiving from the server computer the virtualization profile with the requested sample rate; and filtering the audio signal based on at least the virtualization profile by performing a convolution of the audio signal with the virtualization profile with the requested sample rate.

In some embodiments, the virtualization profile represents an acoustic model of a production environment. In some embodiments, the method further comprises causing the audio signal to be reproduced as sound through an audio transducer.

Various exemplary embodiments further relate to a method for processing an audio signal to influence the reproduction of the audio signal, the method comprising: requesting a virtualization profile from a server computer, wherein the virtualization profile defines a digital audio filter; receiving from the server computer the requested virtualization profile with a design sample rate; resampling the virtualization profile at a required sample rate for the audio signal, responsive to a difference between the required sample rate and the design sample rate; and filtering the audio signal based on at least the virtualization profile with the required sample rate.

In some embodiments, resampling the virtualization profile comprises: interpolating the virtualization profile to obtain a representation of continuous-time bandlimited impulse response (CBIR); and resampling the CBIR at the required sample rate. In some embodiments, filtering the audio signal comprises performing a convolution of the audio signal with the virtualization profile with the required sample rate. In some embodiments, the method further comprises causing the audio signal to be reproduced as sound through an audio transducer simulating a production environment.

Various exemplary embodiments further relate to a method for influencing reproductions of audio signals with virtualization profiles, the method comprising: storing a virtualization profile with a design sample rate, wherein the virtualization profile defines a digital audio filter; receiving a request for the virtualization profile from a client device, wherein the request specifies a requested sample rate for the virtualization profile; resampling, by a computer processor, the stored virtualization profile at the requested sample rate, responsive to a difference between the requested sample rate and the design sample rate; and transmitting the virtualization profile with the requested sample rate to the client device.

In some embodiments, the digital audio filter represents an acoustic model of a production environment comprising at least one of a finite impulse response (FIR) filter, an infinite impulse response (IIR) filter, and a feedback delay network (FDN) filter. In some embodiments, the virtualization profile causes the audio signal to be reproduced through an audio transducer simulating the production environment. In some embodiments, the virtualization profile is stored as a series of filter coefficients in fixed point or float point values. In some embodiments, resampling the virtualization profile comprises: interpolating the virtualization profile to obtain a representation of continuous-time bandlimited impulse response (CBIR); and resampling the CBIR at the requested sample rate. In some embodiments, resampling the CBIR at a lower sample rate than the design sample rate results in fewer filter coefficients, and resampling the CBIR at a higher sample rate than the design sample rate results in more filter coefficients. In some embodiments, the method further comprises scaling the virtualization profile to a different sample rate to achieve a subjective audio effect.

Various exemplary embodiments further relate to a non-transitory computer-readable storage medium storing computer-executable instructions that when executed cause one or more processors to perform operations comprising: storing a virtualization profile with a design sample rate, wherein the virtualization profile defines a digital audio filter; receiving a request for the virtualization profile from a client device, wherein the request specifies a requested sample rate for the virtualization profile; resampling the stored virtualization profile at the requested sample rate, responsive to a difference between the requested sample rate and the design sample rate; and transmitting the virtualization profile with the requested sample rate to the client device.

In some embodiments, the digital audio filter represents an acoustic model of a production environment comprising at least one of a finite impulse response (FIR) filter, an infinite impulse response (IIR) filter, and a feedback delay network (FDN) filter. In some embodiments, the virtualization profile causes the audio signal to be reproduced through an audio transducer simulating the production environment. In some embodiments, resampling the virtualization profile comprises: interpolating the virtualization profile to obtain a representation of continuous-time bandlimited impulse response (CBIR); and resampling the CBIR at the requested sample rate.

Various exemplary embodiments further relate to an audio device for processing an audio signal, the audio device comprising: a communication interface configured for sending a request to a server computer for a virtualization profile, wherein the request specifies a requested sample rate for the virtualization profile, and wherein the virtualization profile defines a digital audio filter simulating a virtualized environment; and receiving from the server computer the requested virtualization profile with the requested sample rate; a storage device for storing the received virtualization profile; and a processor in communication with the storage device and the communication interface, the processor programmed for filtering the audio signal based on at least the virtualization profile by performing a convolution of the audio signal with the virtualization profile with the requested sample rate.

Various exemplary embodiments further relate to an audio device for processing an audio signal, the audio device comprising: a communication interface configured for requesting a virtualization profile from a server computer, wherein the virtualization profile defines a digital audio filter simulating a virtualized environment; and receiving from the server computer the requested virtualization profile with a design sample rate; a storage device for storing the received virtualization profile; and a processor in communication with the storage device and the communication interface, the processor programmed for resampling the virtualization profile at a required sample rate for the audio signal, responsive to a difference between the required sample rate and the design sample rate; and filtering the audio signal based on at least the virtualization profile with the required sample rate.

In some embodiments, resampling the virtualization profile comprises: interpolating the virtualization profile to obtain a representation of continuous-time bandlimited impulse response (CBIR); and resampling the CBIR at the required sample rate. In some embodiments, filtering the audio signal comprises performing a convolution of the audio signal with the virtualization profile at the required sample rate.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
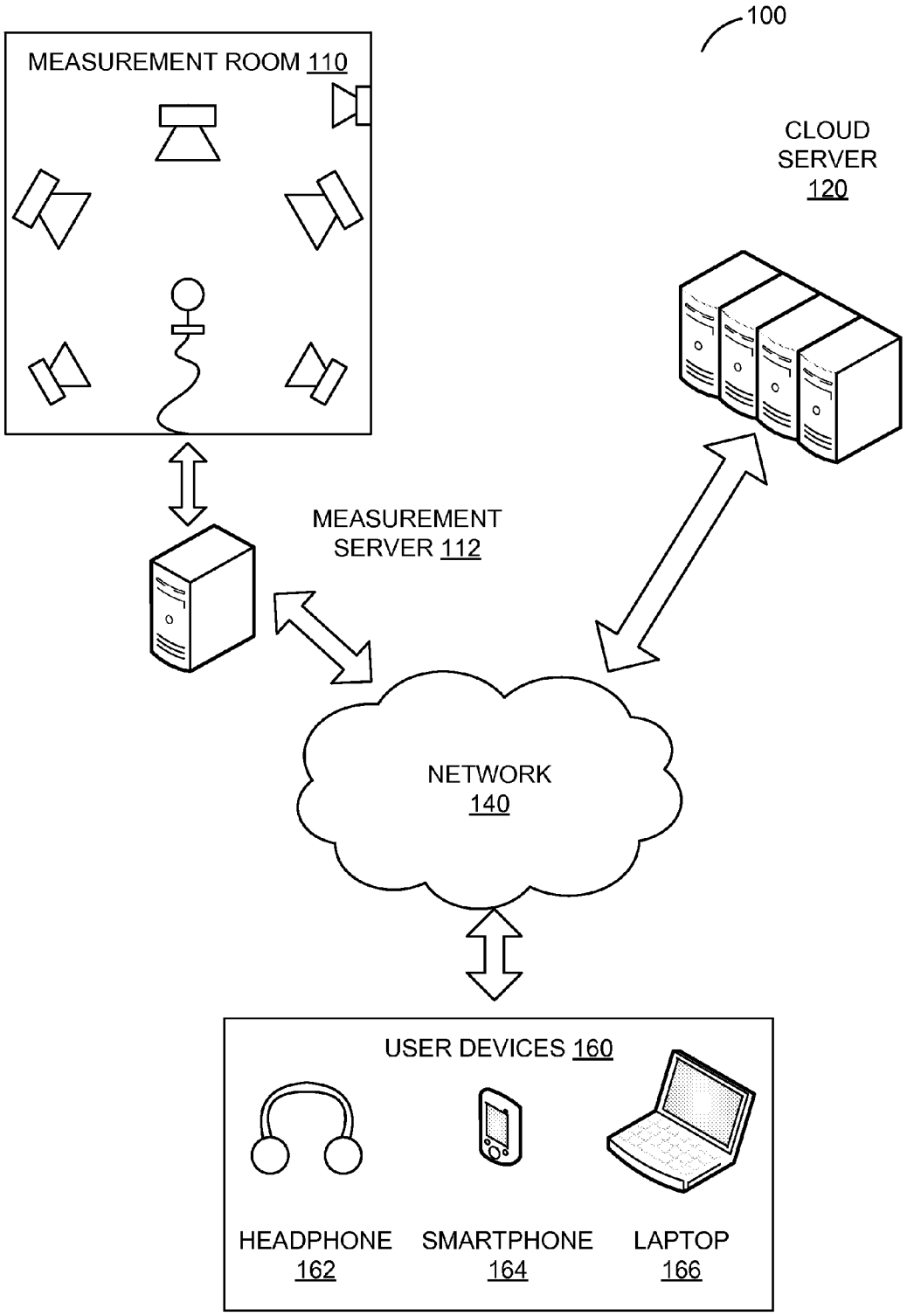
FIG. 1 is a high-level block diagram illustrating an example environment 100 for cloud-based digital audio virtualization service, according to one embodiment.

The detailed description set forth below in connection with the appended drawings is intended as a description of the presently preferred embodiment of the invention, and is not intended to represent the only form in which the present invention may be constructed or utilized. The description sets forth the functions and the sequence of steps for developing and operating the invention in connection with the illustrated embodiment. It is to be understood, however, that the same or equivalent functions and sequences may be accomplished by different embodiments that are also intended to be encompassed within the spirit and scope of the invention. It is further understood that the use of relational terms such as first and second, and the like are used solely to distinguish one entity from another entity without necessarily requiring or implying any actual such relationship or order between such entities.

A sound wave is a type of pressure wave caused by the vibration of an object that propagates through a compressible medium such as air. A sound wave periodically displaces matter in the medium (e.g. air) causing the matter to oscillate. The frequency of the sound wave describes the number of complete cycles within a period of time and is expressed in Hertz (Hz). Sound waves in the 12 Hz to 20,000 Hz frequency range are audible to humans.

The present application concerns a method and apparatus for processing audio signals, which is to say signals representing physical sound. These signals may be represented by digital electronic signals. In the discussion which follows, analog waveforms may be shown or discussed to illustrate the concepts; however, it should be understood that typical embodiments of the invention may operate in the context of a time series of digital bytes or words, said bytes or words forming a discrete approximation of an analog signal or (ultimately) a physical sound. The discrete, digital signal may correspond to a digital representation of a periodically sampled audio waveform. As is known in the art, for uniform sampling, the waveform may be sampled at a rate at least sufficient to satisfy the Nyquist sampling theorem for the frequencies of interest. For example, in a typical embodiment a uniform sampling rate of approximately 44.1 kHz may be used. Higher sampling rates such as 96 kHz or 192 kHz may alternatively be used. The quantization scheme and bit resolution may be chosen to satisfy the requirements of a particular application, according to principles well known in the art. The techniques and apparatus of the invention typically would be applied interdependently in a number of channels. For example, it may be used in the context of a "surround" audio system (having more than two channels).

As used herein, a "digital audio signal" or "audio signal" does not describe a mere mathematical abstraction, but instead denotes information embodied in or carried by a physical medium capable of detection by a machine or apparatus. This term includes recorded or transmitted signals, and should be understood to include conveyance by any form of encoding, including pulse code modulation (PCM), but not limited to PCM. Outputs or inputs, or indeed intermediate audio signals may be encoded or compressed by any of various known methods, including MPEG, ATRAC, AC3, or the proprietary methods of DTS, Inc. as described in U.S. Pat. Nos. 5,974,380; 5,978,762; and 6,487,535. Some modification of the calculations may be required to accommodate that particular compression or encoding method, as will be apparent to those with skill in the art.

The present invention may be implemented in a consumer electronics device, such as a Digital Video Disc (DVD) or Blu-ray Disc (BD) player, television (TV) tuner, Compact Disc (CD) player, handheld player, Internet audio/video device, a gaming console, a mobile phone, or the like. A consumer electronic device includes a Central Processing Unit (CPU) or Digital Signal Processor (DSP), which may represent one or more conventional types of such processors, such as an IBM PowerPC, Intel Pentium (x86) processors, and so forth. A Random Access Memory (RAM) temporarily stores results of the data processing operations performed by the CPU or DSP, and is interconnected thereto typically via a dedicated memory channel. The consumer electronic device may also include permanent storage devices such as a hard drive, which are also in communication with the CPU or DSP over an I/O bus. Other types of storage devices, such as tape drives and optical disk drives, may also be connected. A graphics card is also connected to the CPU via a video bus, and transmits signals representative of display data to the display monitor. External peripheral data input devices, such as a keyboard or a mouse, may be connected to the audio reproduction system over a USB port. A USB controller translates data and instructions to and from the CPU for external peripherals connected to the USB port. Additional devices such as printers, microphones, speakers, and the like may be connected to the consumer electronic device.

The consumer electronic device may utilize an operating system having a graphical user interface (GUI), such as WINDOWS from Microsoft Corporation of Redmond, Wash., MAC OS from Apple, Inc. of Cupertino, Calif., various versions of mobile GUIs designed for mobile operating systems such as Android, and so forth. The consumer electronic device may execute one or more computer programs. Generally, the operating system and computer programs are tangibly embodied in a computer-readable medium, e.g. one or more of the fixed and/or removable data storage devices including the hard drive. Both the operating system and the computer programs may be loaded from the aforementioned data storage devices into the RAM for execution by the CPU. The computer programs may comprise instructions which, when read and executed by the CPU, cause the same to perform the steps to execute the steps or features of the present invention.

The present invention may have many different configurations and architectures. Any such configuration or architecture may be readily substituted without departing from the scope of the present invention. A person having ordinary skill in the art will recognize the above described sequences are the most commonly utilized in computer-readable mediums, but there are other existing sequences that may be substituted without departing from the scope of the present invention.

Elements of one embodiment of the present invention may be implemented by hardware, firmware, software or any combination thereof. When implemented as hardware, the audio codec may be employed on one audio signal processor or distributed amongst various processing components. When implemented in software, the elements of an embodiment of the present invention may be the code segments to perform various tasks. The software may include the actual code to carry out the operations described in one embodiment of the invention, or code that may emulate or simulate the operations. The program or code segments can be stored in a processor or machine accessible medium or transmitted by a computer data signal embodied in a carrier wave, or a signal modulated by a carrier, over a transmission medium. The "processor readable or accessible medium" or "machine readable or accessible medium" may include any medium configured to store, transmit, or transfer information.

Examples of the processor readable medium may include an electronic circuit, a semiconductor memory device, a read only memory (ROM), a flash memory, an erasable ROM (EROM), a floppy diskette, a compact disk (CD) ROM, an optical disk, a hard disk, a fiber optic medium, a radio frequency (RF) link, etc. The computer data signal includes any signal that may propagate over a transmission medium such as electronic network channels, optical fibers, air, electromagnetic, RF links, etc. The code segments may be downloaded via computer networks such as the Internet, Intranet, etc. The machine accessible medium may be embodied in an article of manufacture. The machine accessible medium may include data that, when accessed by a machine, may cause the machine to perform the operation described in the following. The term "data" here refers to any type of information that may be encoded for machine-readable purposes. Therefore, it may include program, code, data, file, etc.

All or part of an embodiment of the invention may be implemented by software. The software may have several modules coupled to one another. A software module may be coupled to another module to receive variables, parameters, arguments, pointers, etc. and/or to generate or pass results, updated variables, pointers, etc. A software module may also be a software driver or interface to interact with the operating system running on the platform. A software module may also be a hardware driver to configure, set up, initialize, send and receive data to and from a hardware device.

One embodiment of the invention may be described as a process which is usually depicted as a flowchart, a flow diagram, a structure diagram, or a block diagram. Although a block diagram may describe the operations as a sequential process, many of the operations may be performed in parallel or concurrently. In addition, the order of the operations may be re-arranged. A process may be terminated when its operations are completed. A process may correspond to a method, a program, a procedure, etc.

Overview

Embodiments of the present invention provide a system and a method for cloud-based digital audio virtualization. The method and system is organized around a cloud computing platform configured to aggregate, manage, and distribute virtualization profiles of the audio content. The virtualization profiles are generally derived from acoustic measurements of the production environment and uploaded to the cloud server. When a listener plays back certain audio content with a user device, the user device may request a corresponding virtualization profile from the cloud server and apply the virtualization profile to the audio content to reproduce the audio content with desired production properties.

FIG. 1 is a high-level block diagram illustrating an example environment 100 for cloud-based digital audio virtualization service, according to one embodiment. The service environment 100 comprises a measurement room 110, a measurement server 112, a cloud server 120, a network 140, and user devices 160. Communication between the measurement server 112, user devices 160, and cloud server 120 is enabled by network 140. The network 140 is typically a content delivery network (CDN) built on the Internet, but may include any network, including but not limited to a LAN, a MAN, a WAN, a mobile wired or wireless network, a private network, or a virtual private network.

The acoustic measurements for the virtualization profiles may be taken in rooms containing high fidelity audio equipment, for example, a mixing studio or a listening room. The room may include multiple loudspeakers, and the loudspeakers may be arranged in traditional speaker layouts, such as stereo, 5.1, 7.1, 11.1, or 22.2 layouts. Other non-standard or custom speaker layouts or arrays may also be used. Measurement room 110 shown in FIG. 1 contains a traditional 5.1 surround arrangement, including a left front loudspeaker, a right front loudspeaker, a center front loudspeaker, a left surround loudspeaker, a right surround loudspeaker, and a subwoofer. While a mixing studio having surround loudspeakers is provided as an example, the measurements may be taken in any desired location containing one or more loudspeakers.

The room acoustics measurement is conducted under the control of measurement server 112. For example, measurement server 112 may send one or more test signals to the one or more loudspeakers inside measurement room 110. The test signals may include a frequency sweep or chirp signal. Alternatively or in addition, a test signal may be a noise sequence such as a Golay code or a maximum length sequence. The acoustic measurements may be obtained by placing a measurement apparatus in an optimal listening position, such as a producer's chair. The measurement apparatus may be a free-standing microphone, binaural microphones placed within a dummy head, or binaural microphones placed within a test subject's ears. As each loudspeaker plays the test signal, the measurement apparatus may record the audio signal received at the listening position and transfer the measurement data to server 112. From the recorded audio signals, measurement server 112 can generate a room measurement profile for each speaker location and each microphone of the measurement apparatus. Additional room measurements may be taken at other locations or orientations in the room, for example, at an "out of sweetspot" position. The "out of sweetspot" measurements may aid in determining the acoustics of measurement room 110 for listeners not in the optimal listening position or improving the acoustic models of the room space including the optimal listening position.

In one embodiment, the virtualization profiles generated by measurement server 112 may be separated into digital audio filters, such as head-related transfer function (HRTF) and binaural room impulse response (BRIR), and/or room equalization (EQ), or other independently modeled characteristics such as early room response or late reverberation. The HRTF and BRIR filters characterize how the measurement apparatus received the sound from each loudspeaker independent of the acoustic effects of the room. The early room response characterizes the early reflections after the sound from each loudspeaker has reflected off the surfaces of the room, while the late reverberation characterizes the sound in the room after the early reflections. The HRTF and BRIR filters may be digitized and stored as audio filter coefficients, and the room EQ can be represented by acoustic models that recreate the acoustics of the room. Similarly, the early and late reverberation can be digitized as audio filter coefficients or acoustic models for simulation. Both the HRTF or BRIR filters, room EQs and other acoustic models may be transmitted and/or stored as part of the virtualization profile.

Measurement server 112 may process the virtualization profiles before uploading the virtualization profiles to cloud server 120. The processing of the virtualization profile by the measurement server 112 includes, but not limited to, validating, aggregating, summarizing, sorting, encoding, encrypting, and compressing, among other processing jobs. The virtualization profiles processed by measurement server 112 are then uploaded to cloud server 120 for distribution. Cloud server 120 maintains the virtualization profiles, which include the full room measurement data and/or the HRTF filter coefficients, early room response parameters, and late reverberation parameters for one or more measurement rooms and one or more listening positions within each measurement room. The virtualization profiles may further include other information, such as headphone frequency response information, headphone identification information, measured loudspeaker layout information, playback mode information, measurement location information, measurement equipment information, and/or licensing/ownership information.

Cloud server 120 stores, manages, and distributes virtualization profiles for the associated audio content. The virtualization profiles can be stored and distributed as metadata that is included in channel based or object based audio bitstream. In this case, the virtualization profile may be embedded or multiplexed in a file header of the audio content, or in any other portion of an audio file or frame. The virtualization data may also be repeated in multiple frames of the audio bitstream. Alternatively or in addition, the virtualization profiles can be requested and downloaded separately from associated audio content as independent data packages. The virtualization profiles may be transferred to the user devices 160 together with the requested audio content or may be transferred separately from the audio content.

When a virtualization profile is requested by user devices 160 for certain audio content, cloud server 120 may need to process the virtualization profile before transmitting the virtualization profile to user devices 160. The processing of the virtualization profiles at cloud server 120 includes, but not limited to, searching, ranking, decoding, decrypting, resampling, and decompressing, among other processing jobs. For example, after receiving a request for virtualization profiles from user devices 160, cloud server 120 may search for virtualization profiles that match identifiers, associated audio content, or any other identification information in the request. In case more than one virtualization profiles are found, cloud server 120 may rank the search result and/or send the list of the profiles to user devices 160 for selection. If the requested virtualization profiles are encoded, encrypted, or compressed, cloud server 120 can decode, decrypt, or decompress the virtualization profile at the request of user devices 160.

In some embodiments, a virtualization profile stored at cloud server 120 is measured by the measurement server 112 at a design sample rate, for example, 48 kHz. If a request from user devices 160 for the virtualization profile with a different requested sample rate than the designed sample rate, cloud server 120 may need to resample the virtualization profile in response to the request. Details of the resampling process are further described below in reference to FIG. 4. In alternate embodiments, the resampling of the virtualization profile can also be performed by the user devices 160 if so desired and indicated by the user devices 160 upon request.

The user devices 160 are any playback or accessory devices that can compute, communicate, and render an audio signal with corresponding virtualization profiles. The user devices 160 include, for example, a headphone 162, a smartphone 164, and a laptop computer 164. Although only three user devices 162, 164 and 166 are shown in FIG. 1, any number of user devices 160, such as personal computers (PCs), tablet PC, mobile devices, set-top boxes (STBs), web appliances, network routers, switches or bridges, or audio/video systems, may communicate with cloud server 120 to acquire virtualization profiles for virtualized playback. In one embodiment, a user may be associated with an account on cloud server 120, and virtualization profiles downloaded/purchased by the user are available through all the user devices associated with the user account.

In one embodiment, when an audio content starts to play on a user device, the audio content may include a flag in its bitstream indicating the user device about available virtualization profiles at cloud server 120 for download/purchase. Once a virtualization profile is downloaded, the user device may process the virtualization profile, for example, resample the virtualization profile to match the digital audio sample rate at the user device. The processed virtualization profile is then applied to filter the audio content for virtualized listening experience. For example, an audio content may be processed in a mixing studio (e.g., measurement room 110), allowing the audio producer to measure the spatialized headphone mix that end-user hears. Later, headphone 162 may download from cloud server 120 and store a virtualization profile generated by measurement server 112 from the measurement for the audio content. If headphone 162 applies the virtualization profile to the audio content, the acoustics and loudspeaker locations of the measured room will be recreated, and the audio content will sound similar to audio played back over the loudspeakers in the measured mixing studio.

Computer Architecture

Figure 2:
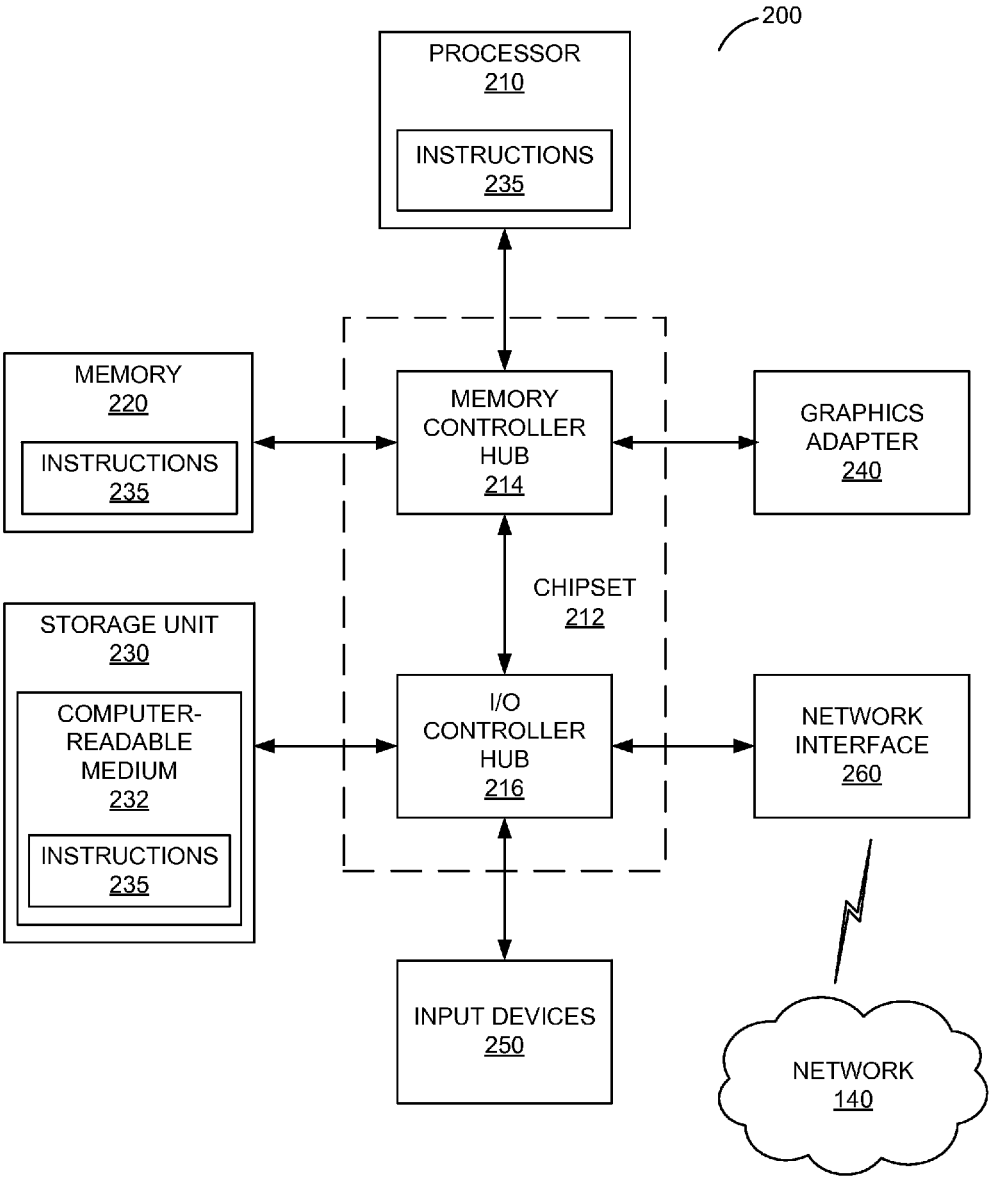
FIG. 2 is a block diagram illustrating components of an example computer system for cloud-based digital audio virtualization service, according to one embodiment.

FIG. 2 is a block diagram illustrating components of an example computer able to read instructions from a computer-readable medium and execute them in a processor (or controller) to implement the disclosed system for cloud-based digital audio virtualization service. Specifically, FIG. 2 shows a diagrammatic representation of a machine in the example form of a computer 200 within which instructions 235 (e.g., software) for causing the computer to perform any one or more of the methods discussed herein may be executed. In various embodiments, the computer operates as a standalone device or connected (e.g., networked) to other computers. In a networked deployment, the computer may operate in the capacity of a server machine or a client machine in a server-client network environment, or as a peer machine in a peer-to-peer (or distributed) network environment.

Computer 200 is such an example for use as measurement server 112, cloud server 120, and user devices 160 in cloud-based digital audio virtualization environment 100 shown in FIG. 1. Illustrated are at least one processor 210 coupled to a chipset 212. The chipset 212 includes a memory controller hub 214 and an input/output (I/O) controller hub 216. A memory 220 and a graphics adapter 240 are coupled to memory controller hub 214. A storage unit 230, a network adapter 260, and input devices 250, are coupled to the I/O controller hub 216. Computer 200 is adapted to execute computer program instructions 235 for providing functionality described herein. In the example shown in FIG. 2, executable computer program instructions 235 are stored on the storage unit 230, loaded into the memory 220, and executed by the processor 210. Other embodiments of computer 200 may have different architectures. For example, memory 220 may be directly coupled to processor 210 in some embodiments.

Processor 210 includes one or more central processing units (CPUs), graphics processing units (GPUs), digital signal processors (DSPs), application specific integrated circuits (ASICs), radio-frequency integrated circuits (RFICs), or any combination of these. Storage unit 230 comprises a non-transitory computer-readable storage medium 232, including a solid-state memory device, a hard drive, an optical disk, or a magnetic tape. The instructions 235 may also reside, completely or at least partially, within memory 220 or within processor 210's cache memory during execution thereof by computer 200, memory 220 and processor 210 also constituting computer-readable storage media. Instructions 235 may be transmitted or received over network 140 via network interface 260.

Input devices 250 include a keyboard, mouse, track ball, or other type of alphanumeric and pointing devices that can be used to input data into computer 200. The graphics adapter 212 displays images and other information on one or more display devices, such as monitors and projectors (not shown). The network adapter 260 couples the computer 200 to a network, for example, network 140. Some embodiments of the computer 200 have different and/or other components than those shown in FIG. 2. The types of computer 200 can vary depending upon the embodiment and the desired processing power. Furthermore, while only a single computer is illustrated, the term "computer" shall also be taken to include any collection of computers that individually or jointly execute instructions 235 to perform any one or more of the methods discussed herein.

Virtualization Profile Resampling

Figure 3:
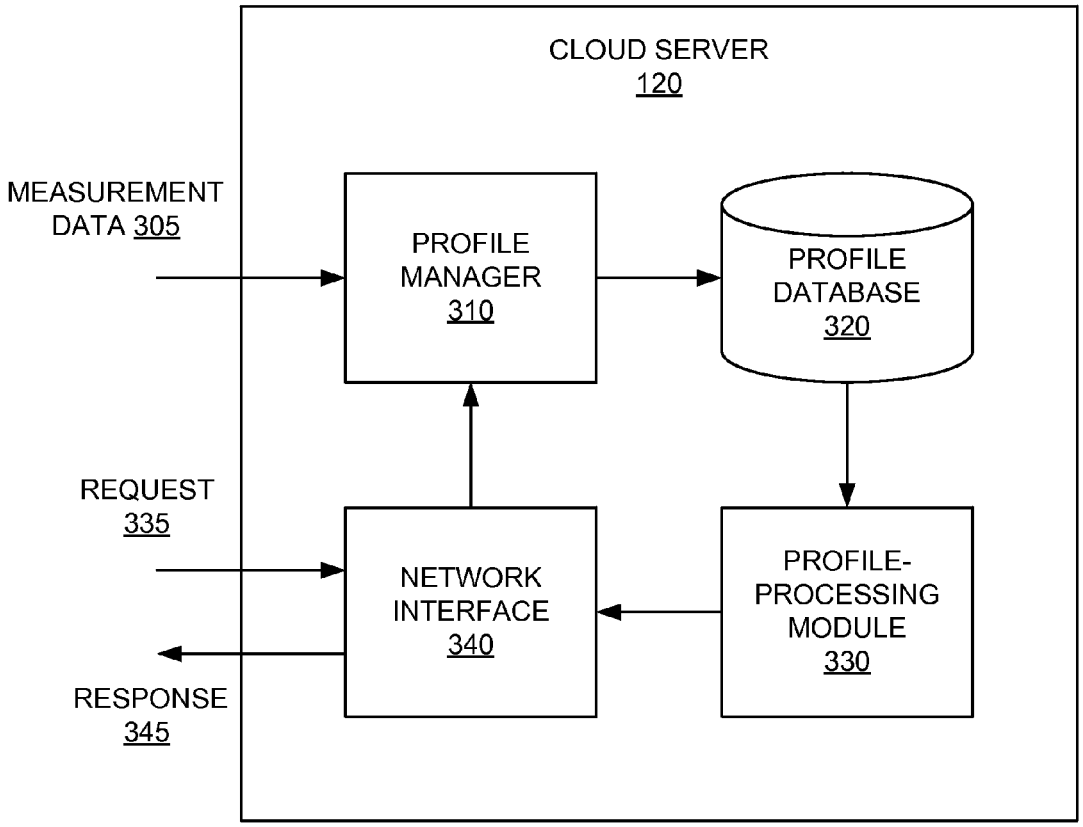
FIG. 3 is a block diagram illustrating functional modules within a cloud server for the cloud-based digital audio virtualization service, according to one embodiment.

Cloud server 120 stores virtualization profiles uploaded by measurement server 112, and distribute the virtualization profiles to user devices 160 over network 140. FIG. 3 is a block diagram illustrating functional modules within a cloud server 120 for the cloud-based digital audio virtualization service. In one embodiment, cloud server 120 comprises a profile manager 310, a profile database 320, a profile-processing module 330, and a network interface 340. As used herein, the term "module" refers to a hardware and/or software unit used to provide one or more specified functionalities. Thus, a module can be implemented in hardware, software or firmware, or a combination of thereof. Other embodiments of could server 120 may include different and/or fewer or more modules.

The profile manager 310 receives measurement data 305 uploaded by the measurement server 112. The measurement data 305 may include raw room measurements and/or virtualization profiles processed by the measurement server 112. The profile manager 310 may also validate, encode, encrypt and compress the measurement data 305 before storing the processed measurement data 305 in the profile database 320. For example, a room response measurement (e.g., room 110) may be sampled at 192 kHz and encoded using 64 bit analog-to-digital converter (A/D) by the measurement server 112 and/or the profile manager 310. The resulting filter coefficients are then stored at the profile database 320 as a virtualization profile associated with the measurement room 110.

When stored at profile database 320, a virtualization profile may be indexed and retrieved by a unique identifier, such as an MD5 checksum or any hash values generated by other hash functions. The unique identifiers of the virtualization profiles can also be derived from other identifying information, such as measurement room information, measured loudspeaker layout information, measurement location information, measurement equipment information, associated audio content identifiers, and/or licensing and ownership information. The virtualization profile identifiers can be generated by the profile manager 310 or received from the measurement server 112. In addition to the virtualization profiles, the profile database 320 may also store other audio production profiles, such as playback device profiles and listener hearing profiles.

Requests for virtualization profiles from user devices 160 are handled by the network interface 340. A profile request 335 may include identification information of the requested virtualization profile. For example, the request 335 can specify a unique profile identifier, or other identification information such as associated audio content, measurement rooms, and/or production or license owners. The profile request 335 may further specify parameters, such as sample rate, A/D length, and bitrate, of the virtualization profile requested. The request 335 may be generated by the user devices 160 automatically based on preconfigured user device profiles and/or user preferences. Alternatively or in addition, the network interface 340 can provide a graphic user interface (GUI), such as a webpage, to the user devices 160 and prompt users to fill in identification information or other parameters of the requested virtualization profiles in advance or on the fly.

In some embodiments, the network interface 340 passes requests for virtualization profiles to the profile manager 310, which searches the requested profiles from the profile database 320. Search results are then forwarded to the profile-processing module 330. A search result may include more than one virtualization profiles, for example, a list of profiles of multiple rooms' measurements. The profile-processing module 330 may choose one or more profiles from the search results and pass the resulting virtualization profiles to the network interface 340, which transmits the virtualization profiles as a response 345 to the profile request 335 back to the requesting user device 160. In some embodiments, the profile database may also log types of virtualization profiles, number of requests, among other preference data. This may allow the cloud server to provide customized recommendations to users based on usage history.

In one embodiment, the profile-processing module 330 helps select which room's acoustics should be returned to the requesting user. For instance, the user may prefer audio content to be processed with a virtualization profile that is most similar to the acoustics of his or her current room. In this case, the profile-processing module 330 may need to communicate with the client devices 160 for acoustic measurement of the user's room with one or more tests. For example, the user may clap his or her hands in the current room, and the hand clap is recorded and processed to determine the acoustic parameters of the room. Alternatively or in addition, other environmental sounds, such as speech, may be analyzed. The tests can be processed either by the cloud server 120 or at the client devices 160. In alternate embodiments, the profile-processing module 330 may simply respond to the user request with one or more virtualization profiles and let the requesting user to select.

In many occasions, users may request virtualization profiles or filters with a different sample rate than the design sample rate captured by the measurement server 112 and/or stored at the profile database 320. One solution is to design the filters, such as an infinite impulse response (IIR) Butterworth filter, with simple operations to be automated on the fly. However, such "simple" designs often require operations (e.g., sin/cos or log) not consistent or available with high enough precision across all platforms. This lack of precision is further compounded when coupling with fixed-point systems. For the cloud-based virtualization filters (e.g., HRTFs, BRIRs, and Room EQs) derived from measured room responses, there may not be sufficient measurement data to retrieve the needed sample rate in a run-time environment.

Another option is to design filters at all possible sample rates offline and store the filters in a database by predicting and measuring room response for every sample rate that might be needed. This method may consume a significant amount of memory and storage because multiple filters are needed and each filter with a number of sample rates, making it unacceptable especially for embedded systems. A third option is to distribute both audio content and filters at the same sample rate. However, it is impractical to require numerous audio applications across various software platforms to process digital audio and filters all at a specific sample rate. Fixing audio sample rate may also cause portability problem and licensing issues. A requirement for end users to clock their global audio path to a fixed sample rate may be prohibitive in terms of computing resources, such as CPU power, memory consumption, and battery life, among other bill of materials cost.

The preferred solution is to design filters containing spectral resolution suitable for any sample rate and automatically adapted to any playback rate on the fly. It is the well-known that a sampled signal is bandlimited to half of the sampling rate (i.e., the Nyquist frequency). Shannon's sampling theorem also suggests that the original signal can be exactly and uniquely reconstructed by interpolating between the sampled values if the sampling rate is higher than the Nyquist frequency. Therefore, the method of bandlimited interpolation, which operates on the foundation Nyquist-Shannon sampling theorem, provides a means of reproducing a continuous-time, yet bandlimited impulse responses from room measurements, rather than "filter coefficients" only at a design sample rate.

In one embodiment, the profile-processing module 330 resamples the virtualization profiles to match the requested sample rate. The resampling of the virtualization profile involves applying interpolation on the virtualization profile, such as HRTF and BRIR filters, to obtain a continuous bandlimit impulse response (CBIR). The interpolated CBIR is then resampled at the requested sample rate before transmitting to the user devices 160. The interpolated CBIRs and resampled virtualization profiles can be stored and/or cached by cloud server 120 for further use if storage space allows. As a result, the method allows filters to be designed once, and later adjusted to any requested sample rates without dependency on any special functions that might deviate due to different implementations. Such a design not only maintains consistent audio fidelity across various platforms, but also simultaneously minimizes memory footprint and allows scalable processing at user devices.

The bandlimited interpolation fits perfectly to the audio filter design choice because the audio frequencies of interest lie in the audible range of 20 Hz-20 kHz. To measure or model an audio filter for "continuous-time", one only needs to sample the impulse response at 40 kHz or higher to minimize memory and/or storage space dedicated towards filter taps. At run time, these filter taps can be interpolated and resampled at any rate to cover the spectrum of interest. For instance, if the interpolated CBIR is resampled at a rate higher than the design sample rate, an input audio signal passing the CBIR is automatically "bandlimited" at the original Nyquist frequency of the filter (i.e. 20 kHz). Whereas in case of a lower resample rate, bandlimited interpolation becomes effectively a low-pass filter for the CBIR with a cutoff frequency at Nyquist frequency of the lower resample rate. In the latter case, loss of the filter specification for higher frequencies is acceptable because those frequencies are absent from the input audio signal being processed in the first place.

Figure 4A:
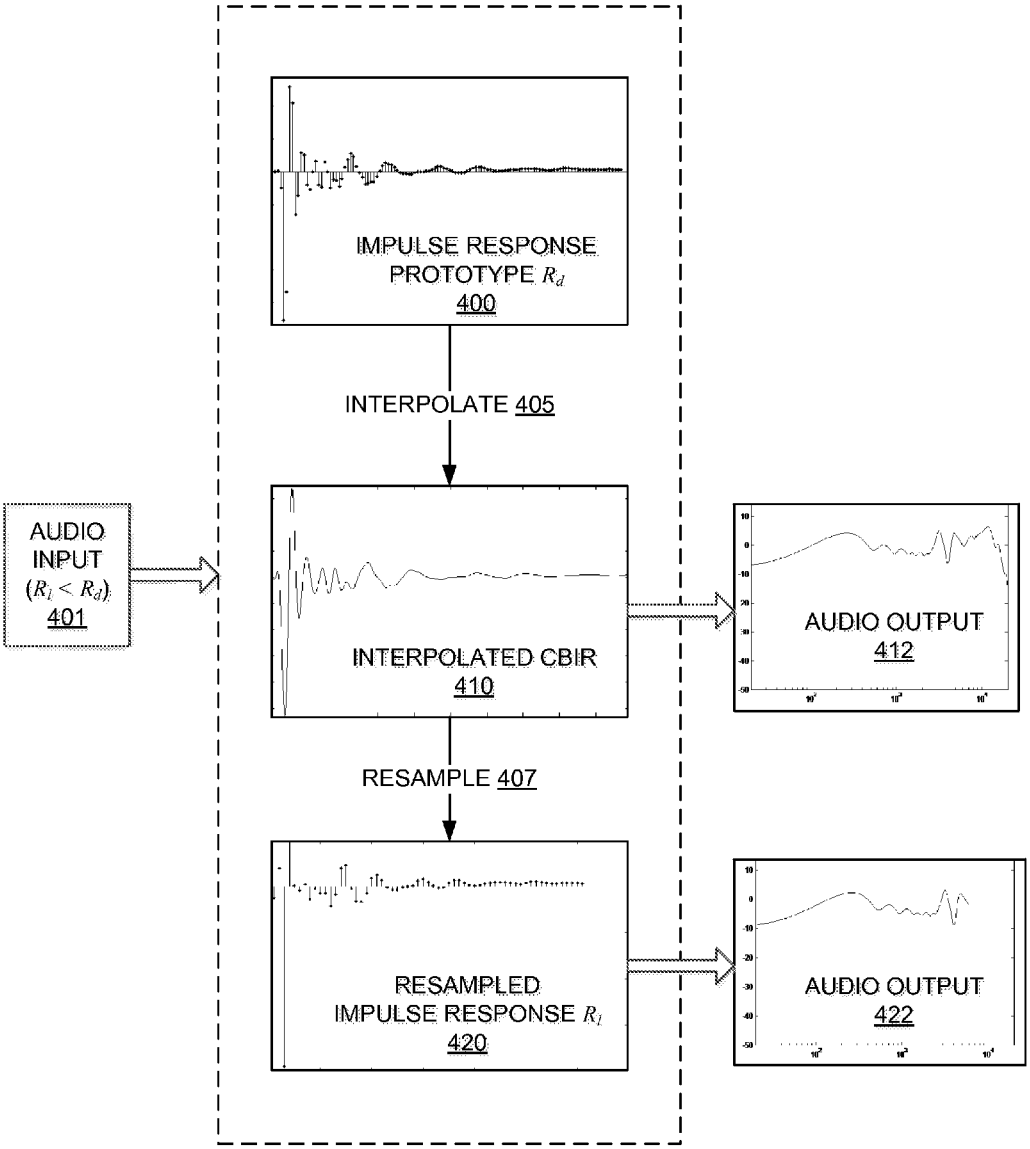
FIG. 4A is a block diagram illustrating the bandlimiting effect of the CBIR resampling at a lower rate than the design sample rate, according to one embodiment.

FIG. 4A is a diagram illustrating the bandlimiting effect of the CBIR resampling at a lower rate than the design sample rate, according to one embodiment. As shown in FIG. 4A, the impulse response prototype 400 is a virtualization profile stored at the profile database 320 with a design sample rate of $R_d$. An audio input 401 has a sample rate of $R_l$. where $R_l<R_d$. The profile-processing module 330 first interpolates 405 the impulse response prototype 400 to obtain an CBIR 410, which is subsequently resampled 407 to produce an impulse response 420 with a target sample rate of $R_l$. Audio output 422 is the result of filtering the audio input 401 through the resampled impulse response 420. Obviously, the audio output 422 has a narrower bandwidth compared to the ideal audio output 412, which is filtered by the CBIR. This process demonstrates a finite impulse response (FIR) design technique based on sampling the continuous impulse response of the ideal filter represented by the interpolated CBIR.

Figure 4B:
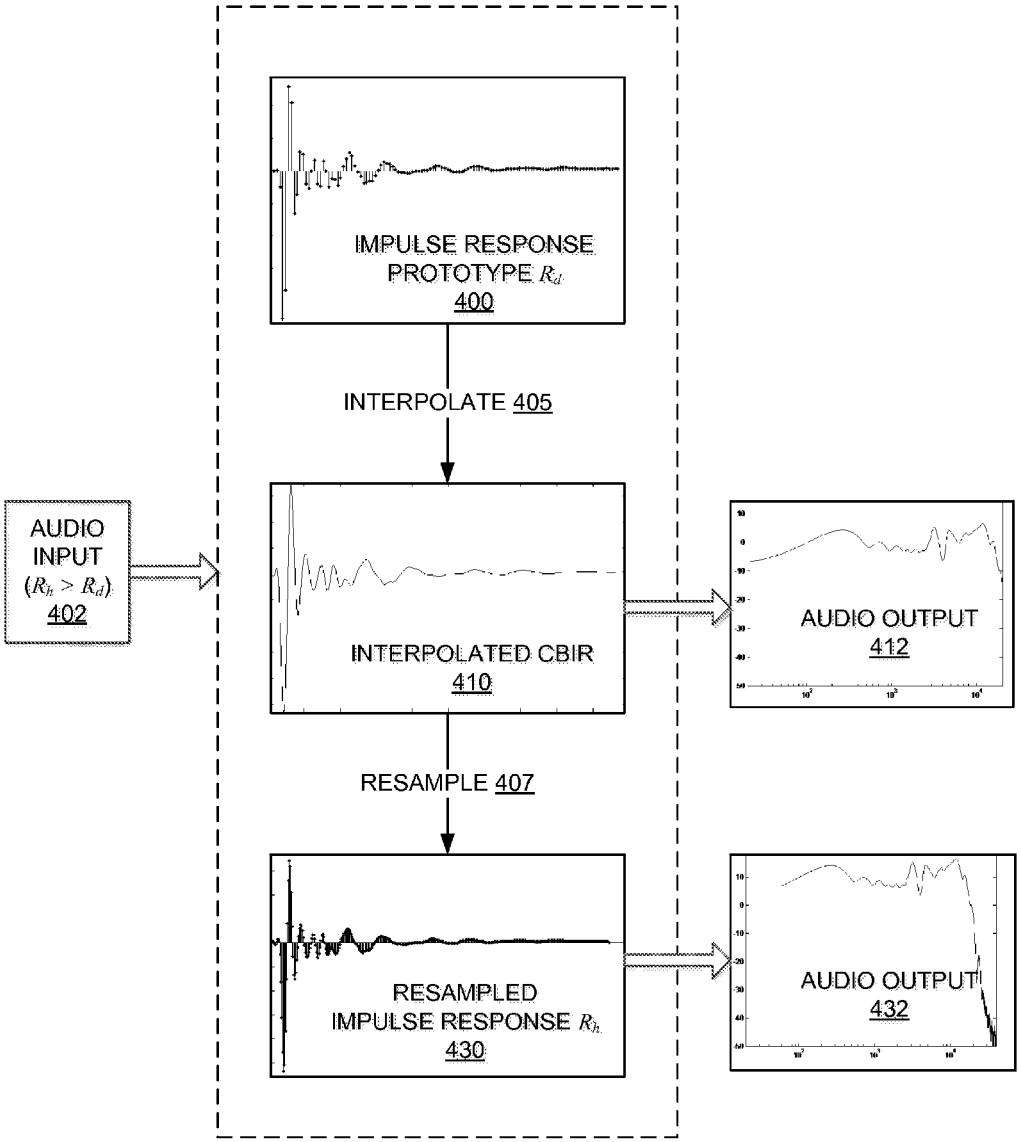
FIG. 4B is a block diagram illustrating the bandlimiting effect of the CBIR resampling at a higher rate than the design sample rate, according to one embodiment.

Similarly, FIG. 4B is a diagram illustrating the bandlimiting effect of the CBIR resampling at a higher rate than the design sample rate, according to one embodiment. In FIG. 4B, audio input 402 has a sample rate of $R_h$. where $R_h>R_d$. The profile-processing module 330 resamples 409 the interpolated CBIR 410 to produce an impulse response 430 with a target sample rate of $R_h$. Audio output 432 is the result of filtering the audio input 402 through the resampled impulse response 430. The resulting audio output 422 is bandlimited at the original Nyquist frequency of the original impulse response. Alternatively, additional bandwidth extension techniques can be applied to resample impulse response 430, which may extend the audio bandwidth of the audio output 432 to that defined by $R_h$ of the audio input 402. But this is generally unnecessary when a sufficient prototype 400 was captured.

Referring back to FIG. 3. In one embodiment, the measurement server 112 and/or the profile database 320 may have limited memory block or storage space for each virtualization profile (e.g. an impulse response prototype). For example, a profile or filter may be optimized for a fixed length of 1K or 1024 taps. On the other hand, filters are measured and sampled for a certain amount of time. At half of a design rate, there will be only half of the number of taps sampled, while at twice of the design rate, there will be twice of the number of taps recorded. It is therefore preferable to design the filter at the highest possible rate, which fits the fixed filter block length. If the filter is sampled at lower rates, the remaining memory space will be padded with zero taps.

Note that since they do not rely on feedback, FIR filters including those resampled through bandlimited interpolation are inherently stable and relatively tolerant of small errors in individual filter coefficients. Hence, the method is suitable for application at various resolutions and fixed-point implementation. However, like any operations, cumulative error could eventually accrue to audible noise in audio applications. As such it is preferable to always refer to the original filter coefficients stored in the profile database 320 for each interpolation and resample operation.

The bandlimited interpolation is suitable for resampling audio particularly because it reconstructs signal sampled at given points rather than approximating the signal through or around the sample points. In one embodiment, a moving sinc function is utilized for interpolating the impulse response prototype; the sinc function serves as the band-limiting low pass filter. In practice, since an ideal sinc does not exist to evaluate each sample to infinity, a special windowed sinc function is used instead. Generally this is achieved with a Kaiser window to control the trade-off between the stop-band attenuation and pass-band transition width. By combining the window and the sinc function, an efficient table implementation can be constructed, which is indexed by the relative time step between the sample rates.

In one embodiment, the profile-processing module 330 also provides controlled frequency scaling. For example, a scaling of a high-frequency resonance can render HRTFs a personalization effect roughly associated with ear-size and/or shape. To achieve this effect, the sample rate of a filter is adjusted by a factor relative to the true audio sampling rate. A factor of 1 (i.e. equal to the true audio rate) means no scaling. A factor less than 1 scales spectral features higher in frequency, while a factor greater than 1 scales spectral features lower in frequency. The frequency scaling reflects compression or expansion of the impulse response in time domain caused by the difference between the sample rates of the filter and the signal.

Figure 5:
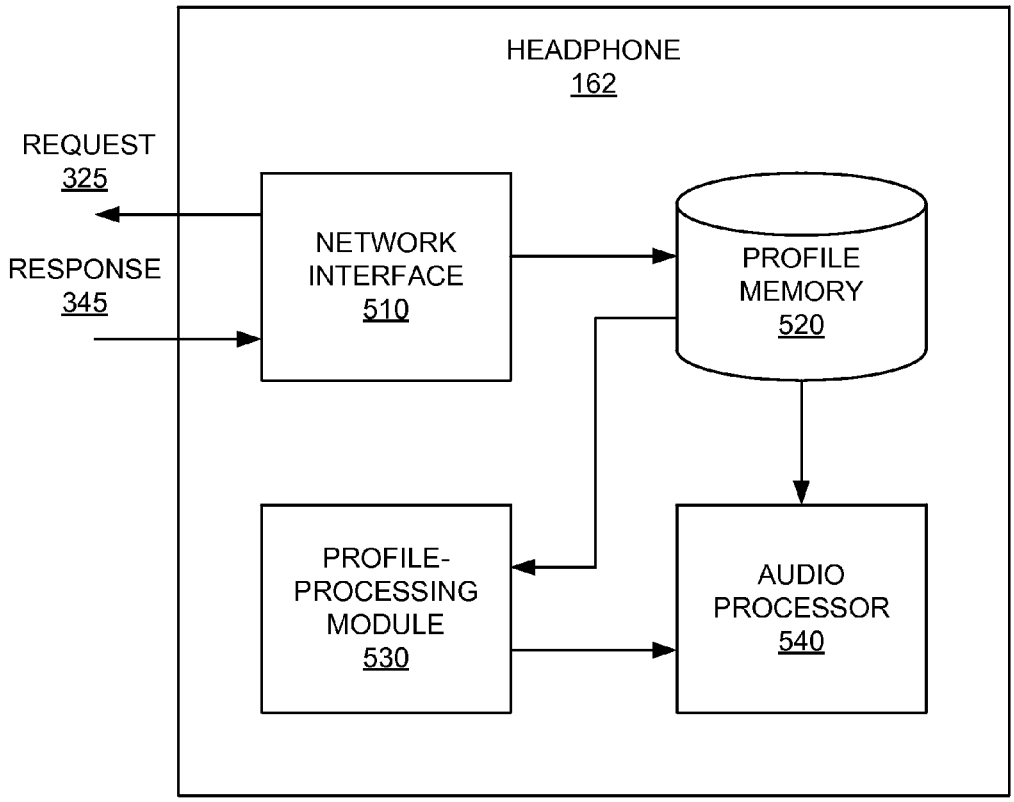
FIG. 5 is a block diagram illustrating functional modules within a user device for the cloud-based digital audio virtualization service, according to one embodiment.

FIG. 5 is a block diagram illustrating functional modules within a headphone 162 for the cloud-based digital audio virtualization service. In one embodiment, the headphone 162 comprises a network interface 510, a profile database 520, a profile-processing module 530, and an audio processor 540. As used herein, the term "module" refers to a hardware and/or software unit used to provide one or more specified functionalities. Thus, a module can be implemented in hardware, software or firmware, or a combination of thereof. The headphone 162 is only one example of many user devices 160 (e.g., smartphone 163, laptop 166, personal audio player, A/V receiver, television, or any other device capable of playing audio and receiving user input), which may comprise different and/or fewer or more functional modules. In some embodiments, the headphone 162 may be coupled to another playback device, which include part or all of the modules described herein.

The headphone 162 communicates with the cloud server 120 via the network interface 510, which may be wired or wireless. The headphone 162 may be associated with a unique user account for the audio virtualization service at the cloud server 120. The user account may include information about the user of the headphone 162, such as the user's identification information, the user's hearing profiles and/or playback device profiles, and other user preferences. The network interface 510 forwards a user request 325 for virtualization profiles to the cloud server 120 and receives response 345 including one or more virtualization or room measurement profiles from the cloud server 120. The virtualization profiles received by the network interface 510 can be associated with the user account and passed to the profile memory 520 for use and storage. The virtualization profiles may be transmitted to the headphone 162 embedded in metadata of the audio content or separately from the audio content.

In case the virtualization profiles being acquired separately from the audio content, the headphone 162 may communicate with the cloud server 120 in advance or on the fly when the user attempts playback of some audio content to determine whether one or more virtualization profiles are associated or intended for the audio content. Hence, the virtualization profiles may be received prior to receiving the audio content, after receiving the audio content, or during reception of the audio content. Once the response 345 including one or more virtualization profiles is downloaded at the network interface 510, the profile-processing module 530 can process the virtualization profile, and the audio processor 540 applies the virtualization profile on the audio content. In one embodiment, the downloaded profiles may be stored in the profile memory 520 after the playback in case they are needed again later.

In some embodiments, the downloaded virtualization profile includes the resampled room measurement profiles, such as HRTF filter coefficients resampled to match the sample rate of the audio content. In this case, the interpolation and resampling of the virtualization profiles is performed by the cloud server 120 at the request of the headphone 162 indicating the target sample rate of the audio content. The profile memory 520 then passes the virtualization profiles to the audio processor 540, which processes the audio content by performing a direct convolution of the audio content with the downloaded virtualization profiles. In addition, if the virtualization profile includes early room response parameters and late reverberation parameters, then the profile-processing module 530 may create an acoustic model of the measurement room 110 and forward the acoustic model to the audio processor to process the audio content. In this case, the early room response parameters and the late reverberation parameters may be convolved with the audio content by the audio processor 540.

Alternatively, the headphone 162 or any other user devices may request original virtualization profiles, such as HRTF filter coefficients, at the design sample rates from the cloud server 120 without any processing. After the original virtualization profiles are received at the network interface 510 and stored at the profile memory 520, the profile-processing module 530 can process the virtualization profile locally. For example, if the design sample rates of the original virtualization profiles are different from the target sample rates of the audio content, the profile processing module 530 first needs to perform interpolation on the original HRTF and BRIR filters, to obtain a continuous bandlimit impulse response (CBIR). The interpolated CBIR is then resampled at the target sample rate before passing to the audio processor. The resampled filter coefficients can also be stored and/or cached by the profile memory 520 if necessary.

In some embodiments, the profile-processing module 530 and the audio processor 540 may process the virtualization profiles and the audio content at the time of playback and/or prior to the time of playback. Alternatively, in other embodiments, the processing of the audio content and the virtualization profiles may be distributed to other user devices. For example, the audio content may be pre-processed with some virtualization profiles at a local server and transmitted to headphone 162. Furthermore, the cloud-based virtualization may be constructed in such a way as to allow pre-processing of audio by content producers. This process may generate an optimized audio track designed to enhance user device playback in a manner specified by the content producer or to retain the desired attributes of the originally mixed surround soundtrack that provides the listener the sonic experience in the original studio.

The result of audio processing by the profile-processing module 530 and the audio processor 540 may be a bit stream that can be decoded using any audio decoder. The bit stream may include a flag that indicates whether or not the audio has been processed with the virtualization profiles. If the bit steam is played back using a legacy decoder that does not recognize the flag, the content may still be played, but without showing any indication on the virtualization of the audio content.

Figure 6:
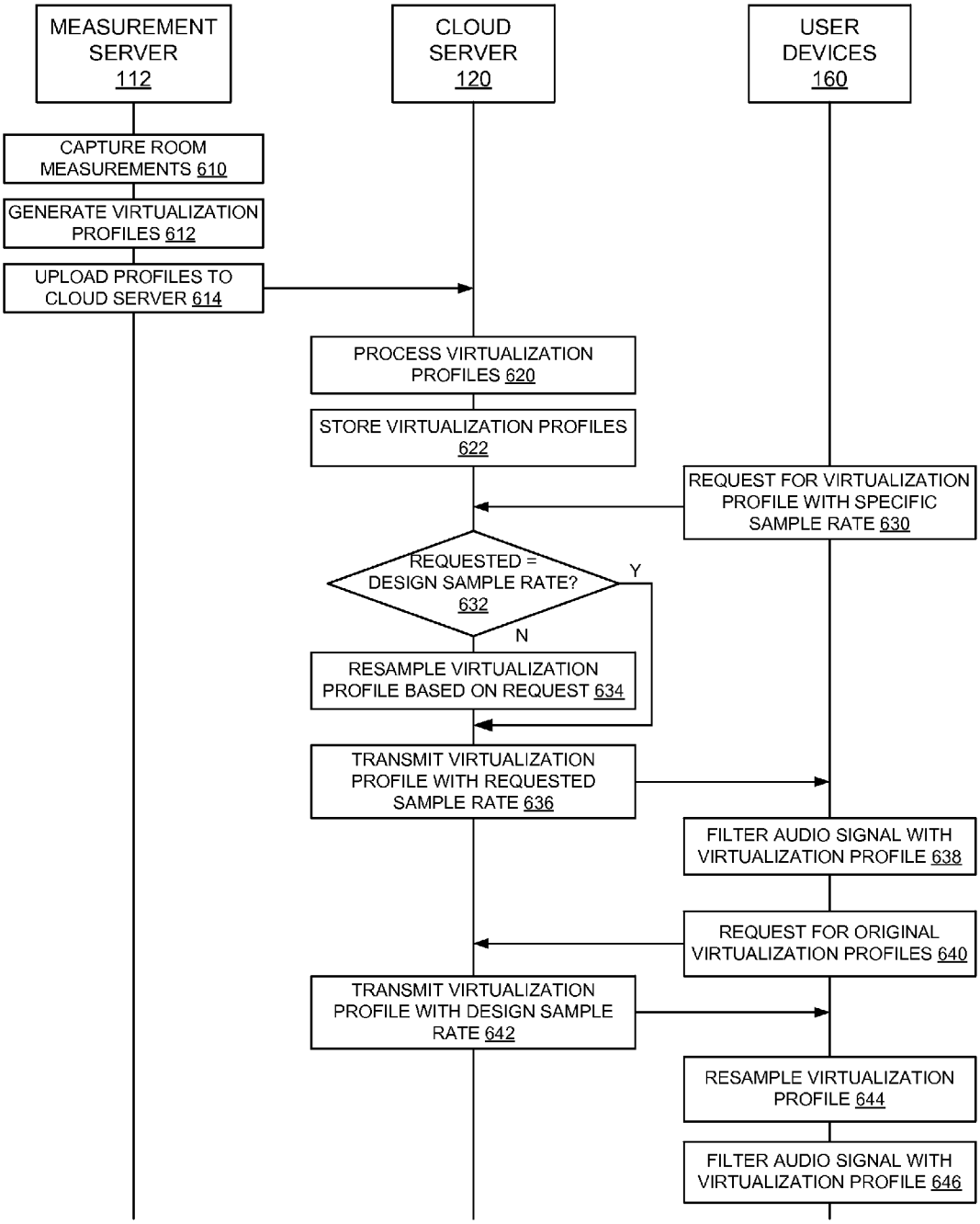
FIG. 6 is a detailed interaction diagram illustrating an example process for providing cloud-based digital audio virtualization, according to one embodiment.

FIG. 6 is a detailed interaction diagram illustrating an example process for providing cloud-based digital audio virtualization, according to one embodiment. It should be noted that FIG. 6 only demonstrates one of many ways in which the embodiments of the cloud-based virtualization may be implemented. The method for providing the digital audio virtualization service involves the measurement server 112, the cloud server 120, and the user devices 160. The method begins with the measurement server 112 capturing 610 measurements in a mixing studio or a listening room with high fidelity audio equipment (e.g., from measurement room 110). Based on the room measurements, the measurement server 112 generates 612 virtualization profiles, such as head-related transfer function (HRTF) or binaural room impulse response (BRIR) filters, and then uploads 614 the virtualization profiles to the cloud server 120.

The cloud server 120 may process 620 the virtualization profiles uploaded by the measurement server 112. For example, the cloud server 120 may validate, encode, encrypt, and compress the virtualization profiles before storing 622 them in its database (e.g., profile database 320). The virtualization profiles, such as HRTF and BRIR filters, are often stored as filter coefficients sampled at a design sample rate. As described above, it is preferable to design the filter at the highest possible sample rate, which fits the filter storage block length for the purpose of interpolation and resampling. For example, a virtualization filter can be sampled as high as 192 kHz with 64 bit A/D convertor length.

Assume that user devices 160 now request 630 for virtualization profiles for certain digital audio content with a target sample rate, which may or may not be the same as the design sample rates of the virtualization profiles stored at the cloud server 120. Receiving the request, the cloud server 120 first determines 632 whether the request target sample rate equals to the design sample rate of the virtualization profiles. If the target sample rate is different from the design sample rate, the cloud server 120 resamples 634 the virtualization profiles based on the request. The resampling process may include, for example, interpolating the original HRTF or BRIR filters to obtain a continuous bandlimit impulse response (CBIR), and resampling the interpolated CBIR to match the target sample rate indicated by the request from the user devices 160. The cloud server 120 then responds 636 to the profile request with the resampled virtualization profiles. If the target sample rate is the same as the design sample rate, the cloud server 160 simply responds 636 to the profile request with the request virtualization profiles without resampling.

After the user devices 160 receive the response from the cloud server 160, the user devices 160 can apply 638 the virtualization profiles to the audio content for playback. For example, the user devices 160 may process the audio content by performing a direct convolution of the audio content with the downloaded virtualization filters of the profiles, so that the audio content is virtualized with similar effect of playback over the loudspeakers in the measurement room 110.

The user devices 160 may also directly request 640 the original virtualization profiles 640 from the cloud server 160, which will respond 642 with the requested virtualization profiles without any resampling. After the user devices 160 receive the response from the cloud server 160, the user devices 160 can resample 644 the virtualization filters of the profiles to match the target sample rate of the audio content before applying 646 the virtualization profiles to the audio content for virtualized playback. The resampling operation performed at the user devices 160, for example, may include a direct convolution of the audio content with the resampled virtualization filters of the profiles.

The particulars shown herein are by way of example and for purposes of illustrative discussion of the embodiments of the present invention only, and are presented in the case of providing what is believed to be the most useful and readily understood description of the principles and conceptual aspects of the present invention. In this regard, no attempt is made to show particulars of the present invention in more detail than necessary for the fundamental understanding of the present invention, the description taken with the drawings make apparent to those skilled in the art how the several forms of the present invention may be embodied in practice.

What is claimed is:

1. A method for processing an audio signal to influence the reproduction of the audio signal, comprising:

sending a request to a server computer for a virtualization profile, wherein the request specifies a requested sample rate for the virtualization profile, and wherein the virtualization profile has a design sample rate and defines a digital audio filter;

receiving from the server computer the virtualization profile with the requested sample rate;

resampling a continuous-time bandlimited impulse response (CBIR) associated with the virtualization profile at the requested sample rate, wherein resampling the CBIR at a lower sample rate than the design sample rate results in fewer filter coefficients and wherein resampling the CBIR at a higher sample rate than the design sample rate results in more filter coefficients; and filtering the audio signal based on at least the virtualization profile by performing a convolution of the audio signal with the virtualization profile with the requested sample rate.

2. The method of claim 1, wherein the virtualization profile represents an acoustic model of a production environment.

3. The method of claim 1, further comprising causing the audio signal to be reproduced as sound through an audio transducer.

4. A method for processing an audio signal to influence the reproduction of the audio signal, comprising:

requesting a virtualization profile from a server computer, wherein the virtualization profile defines a digital audio filter;

receiving from the server computer the requested virtualization profile with a design sample rate;

resampling the virtualization profile at a required sample rate for the audio signal, responsive to a difference between the required sample rate and the design sample rate, wherein resampling the virtualization profile further comprises:

interpolating the virtualization profile to obtain a representation of continuous-time bandlimited impulse response (CBIR);

resampling the CBIR at the required sample rate, wherein resampling the CBIR at a lower sample rate than the design sample rate results in fewer filter coefficients and wherein resampling the CBIR at a higher sample rate than the design sample rate results in more filter coefficients; and filtering the audio signal based on at least the virtualization profile with the required sample rate.

5. The method of claim 4, wherein filtering the audio signal comprises performing a convolution of the audio signal with the virtualization profile with the required sample rate.

6. The method of claim 4, further comprising causing the audio signal to be reproduced as sound through an audio transducer simulating a production environment.

7. A computer-implemented method for influencing reproductions of audio signals with virtualization profiles, the method comprising:

storing a virtualization profile with a design sample rate, wherein the virtualization profile defines a digital audio filter;

receiving a request for the virtualization profile from a client device, wherein the request specifies a requested sample rate for the virtualization profile;

resampling, by a computer processor, the stored virtualization profile at the requested sample rate, responsive to a difference between the requested sample rate and the design sample rate, the resampling the virtualization profile further comprising:

interpolating the virtualization profile to obtain a representation of continuous-time bandlimited impulse response (CBIR);

resampling the CBIR at the requested sample rate, wherein resampling the CBIR at a lower sample rate than the design sample rate results in fewer filter coefficients and wherein resampling the CBIR at a higher sample rate than the design sample rate results in more filter coefficients; and transmitting the virtualization profile with the requested sample rate to the client device.

8. The method of claim 7, wherein the digital audio filter represents an acoustic model of a production environment comprising at least one of a finite impulse response (FIR) filter, an infinite impulse response (IIR) filter, and a feedback delay network (FDN) filter.

9. The method of claim 8, wherein the virtualization profile causes the audio signal to be reproduced through an audio transducer simulating the production environment.

10. The method of claim 7, wherein the virtualization profile is stored as a series of filter coefficients in fixed point or float point values.

11. The method of claim 7, further comprising scaling the virtualization profile to a different sample rate to achieve a subjective audio effect.

12. A non-transitory computer-readable storage medium storing computer-executable instructions that when executed cause one or more processors to perform operations comprising:

storing a virtualization profile with a design sample rate, wherein the virtualization profile defines a digital audio filter;

receiving a request for the virtualization profile from a client device, wherein the request specifies a requested sample rate for the virtualization profile;

resampling the stored virtualization profile at the requested sample rate, responsive to a difference between the requested sample rate and the design sample rate, wherein resampling the virtualization profile further comprises:

interpolating the virtualization profile to obtain a representation of continuous-time bandlimited impulse response (CBIR);

resampling the CBIR at the requested sample rate, wherein resampling the CBIR at a lower sample rate than the design sample rate results in fewer filter coefficients and wherein resampling the CBIR at a higher sample rate than the design sample rate results in more filter coefficients; and transmitting the virtualization profile with the requested sample rate to the client device.

13. The non-transitory computer-readable storage medium of claim 12, wherein the digital audio filter represents an acoustic model of a production environment comprising at least one of a finite impulse response (FIR) filter, an infinite impulse response (IIR) filter, and a feedback delay network (FDN) filter.

14. The non-transitory computer-readable storage medium of claim 13, wherein the virtualization profile causes the audio signal to be reproduced through an audio transducer simulating the production environment.

15. An audio device for processing an audio signal, comprising:

a communication interface configured for:

sending a request to a server computer for a virtualization profile, wherein the request specifies a requested sample rate for the virtualization profile, and wherein the virtualization profile defines a digital audio filter simulating a virtualized environment; and receiving from the server computer the requested virtualization profile with the requested sample rate;

a storage device for storing the received virtualization profile; and a processor in communication with the storage device and the communication interface, the processor programmed for:

resampling a continuous-time bandlimited impulse response (CBIR) associated with the virtualization profile at the requested sample rate, wherein resampling the CBIR at a lower sample rate than the design sample rate results in fewer filter coefficients and wherein resampling the CBIR at a higher sample rate than the design sample rate results in more filter coefficients;

filtering the audio signal based on at least the virtualization profile by performing a convolution of the audio signal with the virtualization profile with the requested sample rate.

16. An audio device for processing an audio signal, comprising:

a communication interface configured for:

requesting a virtualization profile from a server computer, wherein the virtualization profile defines a digital audio filter simulating a virtualized environment; and receiving from the server computer the requested virtualization profile with a design sample rate;

a storage device for storing the received virtualization profile; and a processor in communication with the storage device and the communication interface, the processor programmed for:

resampling the virtualization profile at a required sample rate for the audio signal, responsive to a difference between the required sample rate and the design sample rate, wherein resampling the virtualization profile further comprises:

interpolating the virtualization profile to obtain a representation of continuous-time bandlimited impulse response (CBIR);

resampling the CBIR at the required sample rate, wherein resampling the CBIR at a lower sample rate than the design sample rate results in fewer filter coefficients and wherein resampling the CBIR at a higher sample rate than the design sample rate results in more filter coefficients; and filtering the audio signal based on at least the virtualization profile with the required sample rate.

17. The audio device of claim 16, wherein filtering the audio signal comprises performing a convolution of the audio signal with the virtualization profile at the required sample rate.

* * * * *